US007064284B1

(12) United States Patent
Rakus et al.

(10) Patent No.: US 7,064,284 B1
(45) Date of Patent: Jun. 20, 2006

(54) CIRCUIT BREAKER WITH BUMPER

(75) Inventors: Paul Richard Rakus, Beaver Falls, PA (US); Nathan James Weister, Darlington, PA (US); John Joseph Shea, Pittsburgh, PA (US); Thomas Clements Pendrick, Clinton, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/035,309

(22) Filed: Jan. 13, 2005

(51) Int. Cl.
*H01H 1/22* (2006.01)

(52) U.S. Cl. ..... 200/244; 200/400

(58) Field of Classification Search ..... 200/400, 200/401, 244, 288; 335/202; 218/22, 30, 218/31, 32
See application file for complete search history.

(56) References Cited

U.S. PATENT DOCUMENTS 4,644,120 A * 2/1987 Tedesco ..... 200/401
4,644,122 A * 2/1987 Farley et al. ..... 200/304
4,645,890 A * 2/1987 Paton et al. ..... 200/401
4,645,891 A * 2/1987 Changle ..... 200/401
5,023,416 A * 6/1991 Oyama et al. ..... 200/244
5,023,583 A * 6/1991 Bratkowski et al. ..... 335/195
5,117,211 A * 5/1992 Morgan et al. ..... 335/202
5,266,760 A * 11/1993 Link et al. ..... 200/244
5,938,008 A 8/1999 Wehrli, III et al.
6,005,206 A 12/1999 Rakus et al.
6,246,021 B1 * 6/2001 Thilker et al. ..... 200/288
6,563,407 B1 * 5/2003 Kramer ..... 335/16
6,590,172 B1 * 7/2003 Gadre et al. ..... 200/244
6,800,824 B1 * 10/2004 Slepian et al. ..... 200/400

* cited by examiner

*Primary Examiner*—Elvin G. Enad
*Assistant Examiner*—Lisa Klaus
(74) *Attorney, Agent, or Firm*—Martin J. Moran

(57) ABSTRACT

An improved circuit breaker includes a case, a movable arm, and a bumper retained within a receptacle formed on the case. The bumper is retained in the receptacle by a number of spaced ribs that engage certain portions of the bumper yet permit deformations of other portions of the bumper into an expansion region. By employing a bumper made of a material having a low coefficient of restitution, deformation of the bumper tends to dissipate the energy of a removable arm impacting the bumper. The bumper can be installed, removed, and replaced substantially without requiring the use of an adhesive. The movable arm engages the bumper on a corner of the bumper to provide the bumper with an effectively progressive spring rate.

2 Claims, 2 Drawing Sheets

CIRCUIT BREAKER WITH BUMPER

BACKGROUND OF THE INVENTION

1. Field of the Invention

The invention relates generally to circuit breakers and, more particularly, to a circuit breaker having a bumper.

2. Description of the Related Art

Circuit breakers are generally well known and are used in numerous applications. Circuit breakers can be used to interrupt a circuit under certain predetermined circumstances, and can be used for other purposes.

A typical circuit breaker might include a set of separable contacts that can be separated in certain predetermined circumstances to open a circuit. The separable contacts might include one or more movable contacts that are disposed on a movable arm which, when moved, can separate the movable contacts from one or more stationary contacts to interrupt the circuit. The movable arm may, for example, be a movable arm that is movable by an operating mechanism. While circuit breakers have been generally effective for their intended purposes, such circuit breakers have not, however, been without limitation.

Circuit breakers are oftentimes required to interrupt a circuit very rapidly. The operating mechanism may need to pivot the movable arm at a high speed in order to interrupt the circuit. In addition to including an operating mechanism, some circuit breakers may be configured to further include a "blow open" feature. Such a "blow open" feature may be provided, for instance, by arranging the conductors within the circuit breaker in such a fashion that the electrical fields around the conductors magnetically propel the movable arm to rapidly pivot in certain overcurrent conditions.

A movable arm that is moving at a high velocity must ultimately be stopped and the kinetic energy thereof dissipated in some fashion. Some circuit breakers include hard stops against which the movable arms impact, although such hard stops have drawbacks that should be apparent. While certain cushioning systems can be employed to decelerate a movable arm, many cushioning systems have only a limited ability to dissipate the energy of the movable arm, which can undesirably result in a rebounding of the movable arm and potential consequent reclosing of the circuit.

The mounting and retention of such cushioning systems within circuit breakers has also had limitations. While some cushioning systems have been adhered within circuit breakers, the adhesives employed have been known to become unreliable over time. Moreover, the use of such adhesives tends to introduce various uncertainties into the operation of the breaker based upon, for example, the quantity of adhesive employed, the techniques used in applying and curing the adhesive, and the like. Additionally, an adhered cushioning system can be difficult to replace. It thus would be desirable to provide an improved circuit breaker having an improved cushioning system.

SUMMARY OF THE INVENTION

An improved circuit breaker includes a case, a movable arm, and a bumper retained within a receptacle formed on the case. The bumper is retained in the receptacle by a number of spaced ribs that engage certain portions of the bumper yet permit deformations of other portions of the bumper into an expansion region. By employing a bumper made of a material having a low coefficient of restitution, deformation of the bumper tends to dissipate the energy of a movable arm impacting the bumper. The bumper can be installed, removed, and replaced substantially without requiring the use of an adhesive. The movable arm engages the bumper on a corner of the bumper to provide the bumper with an effectively progressive spring rate.

Accordingly, an aspect of the invention is to provide an improved circuit breaker having a bumper that decelerates a movable arm of the circuit breaker.

Another aspect of the invention is to provide an improved circuit breaker having a bumper mounted within a receptacle on the case of the circuit breaker.

Another aspect of the invention is to provide an improved circuit breaker having a bumper that is removably retained on a case of the circuit breaker.

Another aspect of the invention is to provide an improved circuit breaker having a bumper disposed on a case of the circuit breaker, with the bumper being retained on the case substantially without requiring the use of adhesive materials to adhere the bumper to the case.

Another aspect of the invention is to provide an improved circuit breaker having a bumper disposed on a case of the circuit breaker, with the bumper being structured to decelerate a movable arm of the circuit breaker.

Another aspect of the invention is to provide an improved circuit breaker having a bumper mounted on a case of the circuit breaker, with the bumper being structured to dissipate the kinetic energy of a movable arm contacting the bumper.

Accordingly, an aspect of the invention is to provide an improved circuit breaker, the general nature of which can be stated as including a case, a plurality of retention members disposed on the case, a resilient bumper engaged by at least a pair of retention members of the plurality of retention members to retain the bumper on the case, and a movable arm disposed on the case. The movable arm is structured to impact the bumper in at least a first predetermined situation to dissipate kinetic energy of the movable arm.

BRIEF DESCRIPTION OF THE DRAWINGS

A further understanding of the invention can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
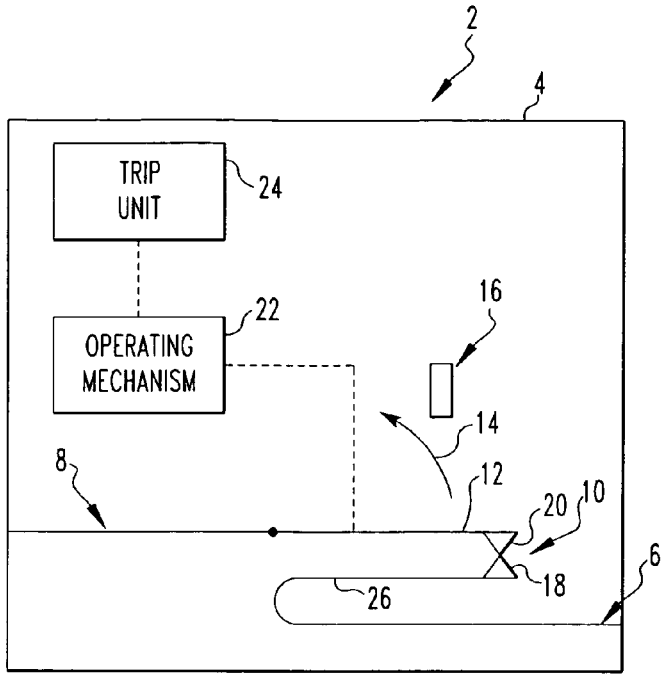
FIG. 1 is a schematic view of an improved circuit breaker in accordance with the invention.

An improved circuit breaker 2 in accordance with the invention is indicated schematically in FIG. 1. The circuit breaker 2 can be generally stated as including a case 4, a line conductor 6, a load conductor 8, and a set of contacts 10 that are separable to interrupt a circuit. The load conductor 8 includes a movable member in the form of a movable arm 12 that is pivotable with respect to the line conductor 6 in a direction indicated generally by the arrow 14 in FIG. 1 in certain predetermined circumstances. The movable arm 12 can be considered to be a component of a contact carrier assembly 23 that is shown in part in FIG. 2 and that can, for example, be operated by an operating mechanism 22 in a well known fashion to separate the set of contacts 10. The circuit breaker 2 additionally and advantageously includes a bumper 16 that is engageable by the movable arm 12, as will be set forth in greater detail below.

The set of contacts 10 includes a stationary contact 18 that is disposed on the line conductor 6 and a movable contact 20 that is disposed on the movable arm 12 of the load conductor 8. A circuit that includes the circuit breaker 2 generally is interrupted when the stationary contact 18 and the movable contact 20 are separated from one another.

The operating mechanism 22 is cooperable with the contact carrier assembly which pivots the movable arm 12 in response to signals from a trip unit 24 of the exemplary circuit breaker 2. It is understood that the operating mechanism 22 and the trip unit 24 can be of numerous configurations and that their depiction in FIG. 1 is representative.

The exemplary line conductor 6 of the exemplary circuit breaker 2 additionally includes a reverse loop 26 that is configured such that magnetic forces between the reverse loop 26 and movable arm 12 can cause the movable arm 12 to pivot in the direction indicated by the arrow 14 in certain predetermined overcurrent situations to separate the set of contacts 10. The reverse loop 26 thus provides to the circuit breaker 2 an exemplary "blow open" feature, although it is noted that the circuit breaker 2 can be configured to not include the "blow open" feature without departing from the concept of the invention.

Figure 2:
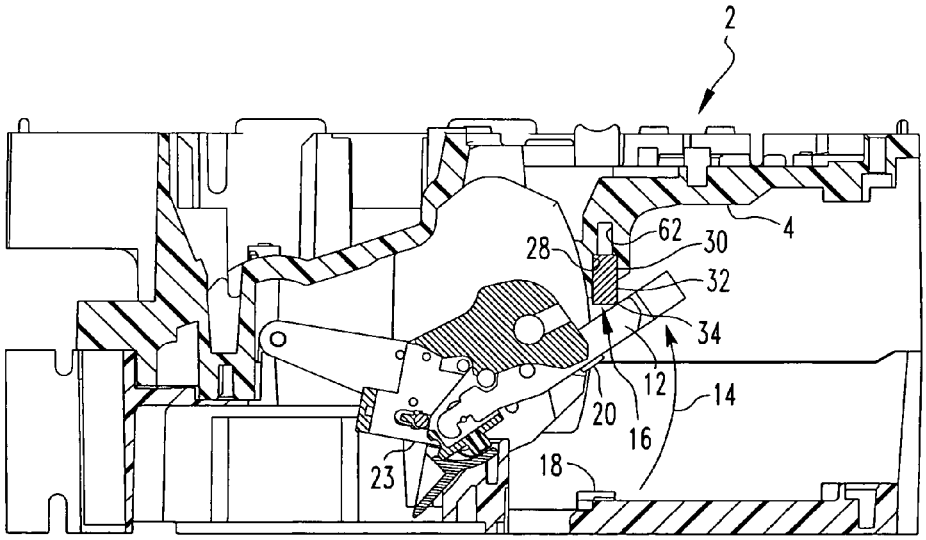
FIG. 2 is a cut away side view of a portion of a pole of the circuit breaker of FIG. 1.

A portion of the circuit breaker 2 is shown in a cut away fashion in FIG. 2. As can be seen in FIG. 2, the bumper 16 is disposed in a receptacle 28 which, in the depicted exemplary embodiment, is formed in the case 4. It is understood that in other embodiments (not shown) a receptacle can be provided in other fashions without departing from the concept of the invention. As will be described in greater detail below, the exemplary bumper 16 is removably retained in the receptacle 28.

As can be further seen from FIG. 2, the bumper 16 can be said to include a retained portion 30 and a protruding portion 32, with the retained portion 30 being disposed substantially within the receptacle 28, and with the protruding portion 32 generally protruding outwardly from the receptacle 28. The exemplary bumper 16 is formed of a resilient material which can, for example, be a fluoroelastomer such as may be sold under the name VITON by DuPont Dow, although other materials can be appropriately employed without departing from the concept of the invention. As employed herein, the expression "resilient" and variations thereof shall refer broadly to a material property which enables an item to have a tendency to return to substantially its original shape after being strained in a predetermined environment. The material of the bumper 16 may be chosen, for example, based upon one or more of the following considerations or other considerations: a temperature range that is suited to use within the circuit breaker 2, flame resistant properties that are suited to the environment within the circuit breaker 2, toughness in an arc chamber environment, an ability to dissipate energy by having a low coefficient of restitution, and the like. In the exemplary embodiment presented herein, the bumper 16 is configured to include a corner 34 that is engageable by the movable arm 12 during a rotation of the movable arm 12 to effectively provide the bumper 16 with a progressive spring rate.

Figure 3:
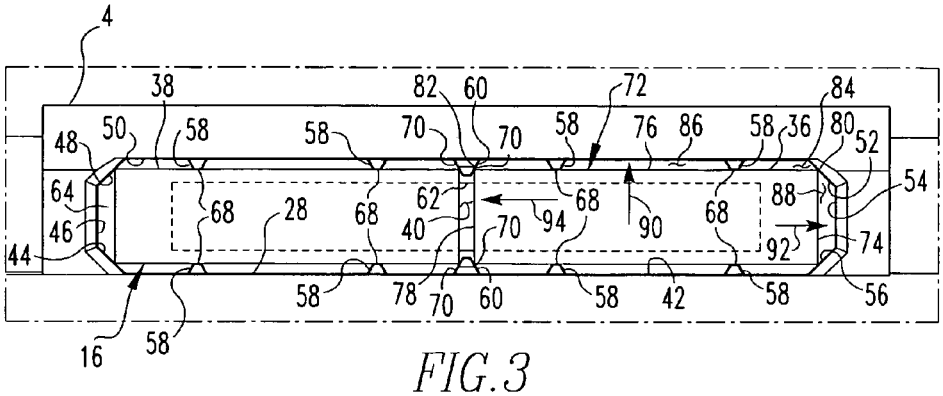
FIG. 3 is a top plan view of a receptacle of a case of the circuit breaker of FIG. 1, with a bumper being disposed in the receptacle.

As can be understood from FIG. 3, the exemplary bumper 16 is configured as a two-part member, that is, the bumper 16 includes a first cushion 36 and a second cushion 38 that are disposed adjacent one another with a space 40 therebetween. In the exemplary embodiment depicted herein, the movable arm 12 is configured to be engageable with both the first cushion 36 and the second cushion 38 when the movable arm 12 is pivoted in the direction indicated by the arrow 14. The first and second cushions 36 and 38 advantageously are deformable by the movable arm 12 in a fashion that decelerates the movable arm 12 and that dissipates at least a portion of the rotational energy of the movable arm 12 in a fashion that limits rebound of the movable arm 12 away from the bumper 16. In other embodiments (not shown) the bumper 16 can include only of a single piece of material or can include more than two pieces of material without departing from the concept of the invention.

Figure 4:
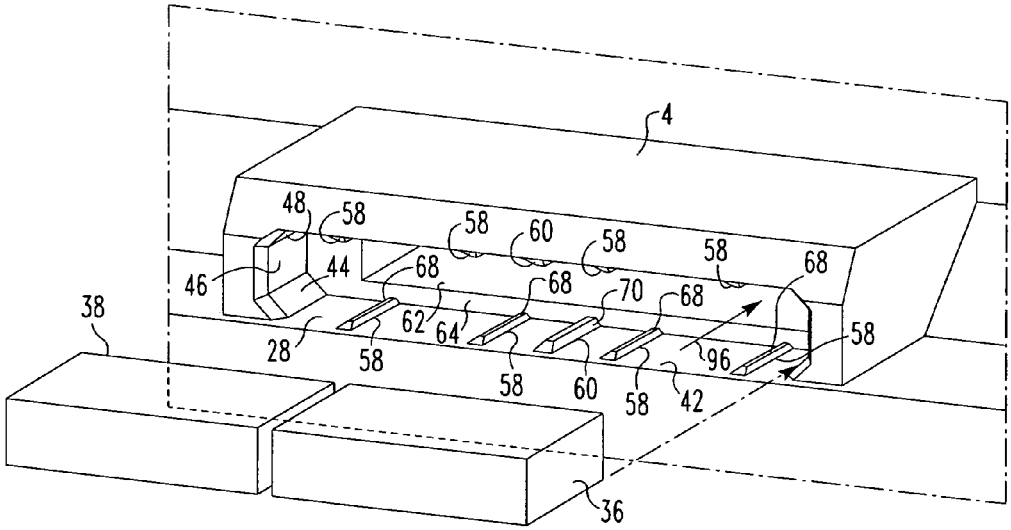
FIG. 4 is an exploded isometric view of the receptacle.

As can be understood from FIGS. 3 and 4, the case 4 is formed to include a first wall 42, a second wall 44, a third wall 46, a fourth wall 48, a fifth wall 50, a sixth wall 52, a seventh wall 54, and an eighth wall 56 that generally define the receptacle 28 and are thus disposed adjacent the receptacle 28. As can be understood from FIGS. 2–4, the case 4 additionally includes a relief 62 formed therein that is in communication with the receptacle 28. A ledge 64 is disposed between receptacle 28 and relief 62 and is, in the depicted exemplary embodiment, of a generally planar configuration.

The case 4 additionally includes a plurality of elongated first protrusions 58 that are formed on the first and fifth walls 42 and 50, and further includes a pair of elongated second protrusions 60 formed on the first and fifth walls 42 and 50. The first and second protrusions 58 and 60 are elongated in a direction extending generally into an interior of the receptacle 28 from a location at an exterior thereof and are generally in the form of ribs. The first protrusions 58 are arranged on the first and fifth walls 42 and 50 in opposing pairs and each protrude away from the first wall 42 or the fifth wall 50 in a direction toward the receptacle 28. The second protrusions 60 similarly are arranged on the first and fifth walls 42 and 50 in an opposed pair and each protrude away from the first wall 42 or the fifth wall 50 in a direction toward the receptacle 28. Each first protrusion 58 includes a generally planar frontal surface 68 that is engageable with the bumper 16. Each second protrusion 60 includes a pair of lateral surfaces 70 that are each engageable with the bumper 16. The first protrusions 58, the second protrusions 60, and the second, fourth, sixth, and eighth walls 44, 48, 52, and 56 can all be considered to be retention members which resist movement of a portion of the bumper 16 that is contacted by the respective retention member but permit deformation of regions of the bumper 16 adjacent the regions contacted by the respective retention members. The bumper 16 can also be said to be slidable engaged by the first protrusions 58, the second protrusions 60, and the second, fourth, sixth, and eighth walls 44, 48, 52, and 56. The ledge 64 can also be said to be such a retention member, but the bumper 16 is not slidably engaged by the ledge 64. Rather, the ledge 64 serves as a substantially rigid stop against which the bumper 16 is engageable to resist sliding movement of the bumper 16 in a direction into the receptacle 28 toward the relief 62.

As can be understood from FIG. 3, the first and second cushions 36 and 38 are retained in the receptacle 28 by engagement with the first protrusions 58, the second protrusions 60, the second wall 44, the fourth wall 48, the sixth wall 52, and the eighth wall 56. The exemplary first and second cushions 36 and 38 are each of a rectangular parallelepiped configuration. More particularly, and by way of example, the first cushion 36 has an exterior surface 72 that includes a first surface 74, a second surface 76, and a third surface 78, as well as other surfaces. The first surface 74 and the second surface 76 meet one another at a first intersection 80. The second surface 76 and the third surface 78 meet one another at a second intersection 82. The exemplary first and second intersections 80 and 82 are in the form of corners.

The second surface 76 is engageable with the frontal surfaces 68 of a pair of the first protrusions 58 disposed on the fifth wall 50. The first intersection 80 is engageable with the sixth wall 52, and the second intersection 82 is engageable with one of the lateral surfaces 70 of the second protrusion 60 disposed on the fifth wall 50.

It can be seen that the portions of the first cushion 36 that are contacted by the first protrusions 58 at the second surface 76 are resisted from being deformed in a first direction indicated by the arrow 90. However, regions of the first cushion 36 adjacent those regions contacted by the aforementioned first protrusions 58 are permitted to be deformable in the first direction 90.

In this regard, it can also be seen that the receptacle 28 is configured to provide an expansion region 84 that is disposed adjacent the bumper 16. The expansion region 84 includes, for example, the space between the second surface 76 and the fifth wall 50, as is indicated generally by the numeral 86. Other similar regions can be seen at other locations between the bumper 16 and the first and fifth walls 42 and 50. Similarly, another expansion region is depicted as including the space between the first surface 72 and the region bounded by the sixth, seventh, and eight walls 52, 54, and 56, as is indicated generally by the numeral 88. The expansion region 84 can also be said to include the space 40 between the first and second cushions 36 and 38, and further can be said to include the relief 62.

In a situation where the movable arm 12 impacts the bumper 16 in the manner depicted generally in FIG. 2, portions of the bumper 16 that are not contacted by a retention member can be deformed, for example, in the first direction 90 generally into the portion of the expansion region 86, in a second direction 92 into the portion of the expansion region 88, in a third direction 94 into the space 40 between the first and second cushions 36 and 38, and in a fourth direction 96 (FIG. 4) into the relief 62. Other such deformations into the aforementioned expansion region 84 will be apparent. Deformation of a portion of the bumper 16 into the relief 62 likely would result from the bumper 16 engaging the ledge 64, with deformation of portions of the bumper 16 not engaged with the ledge 64 being deformable into the relief 62.

The low coefficient of restitution of the exemplary bumper 16 allows the bumper 16 to dissipate the kinetic energy of the movable arm 12 through deformation of the bumper 16. As such, while movable arm 12 may approach the bumper 16 with a high level of rotational kinetic energy, the rotational kinetic energy is in large part transferred to the bumper 16 where, upon deformation of portions of the bumper 16 into the expansion region 84, the energy is dissipated. As such, rebound of the movable arm 12 from the bumper 16 is largely avoided, which thereby resists, for example, reinitiation of current flow between the stationary and movable contacts 18 and 20.

The engagement of the first intersection 80 with the sixth wall 52, and the engagement of the second intersection 82 with the lateral surface 70 of one of the second protrusions 60, for example, causes the expansion region 84 to be large and to therefore permit significant deformations of the bumper 16 into the expansion region 84, which dissipates energy, while still securely retaining the bumper 16 within the receptacle 28. In this regard, the first and second cushions 36 and 38 typically will be installed in the receptacle 28 with at least a nominal interference fit between at least some of the retention members.

With regard to engagement, for example, of the first intersection 80 with the sixth wall 52, it can be seen that the sixth wall 52 is oriented oblique to both the first surface 74 and second surface 76. As employed herein, the expression "oblique" and variations thereof shall refer broadly to a relationship that is neither parallel nor perpendicular. The same type of oblique arrangement exists between the second intersection 82 and the lateral surfaces 70 of the respective second protrusion 60. Other similar oblique arrangements can be seen in FIG. 3. Such oblique arrangements allow the expansion region 84 to be relatively large, thereby facilitating deformation and dissipation of energy, and further provide to the bumper 16 a progressive spring rate with regard to deformations in the direction of, for example, the sixth wall 52, the aforementioned lateral surface 70, and the like.

The bumper 16, i.e., the first and second cushions 36 and 38, can be readily installed in the receptacle 28 with the nominal interference fit, and the nominal interference fit retains the first and second cushions 36 and 38 in the receptacle 28. Such nominal interference fit advantageously retains the first and second cushions 36 and 38 in the receptacle 28 without requiring the use of an adhesive to adhere the first and second cushions 36 and 38 to the case 4.

The first and second cushions 36 and 38 can be readily removed and replaced, if needed, which is a distinct advantage over systems wherein energy absorbing and/or dissipating members are adhered to surfaces within circuit breakers. Each time the movable arm 12 engages the bumper 16, the bumper 16 is re-seated within the receptacle 28 and against the ledge 64. Such engagement can, for example, occur when the movable arm 12 is pivoted in response to, for example, a tripping event or switching the circuit breaker 2 to an OFF position. Depending upon the configuration of the circuit breaker 2, a resetting operation of the operating mechanism 22 might cause the movable arm 12 to engage the bumper 16 and to provide a re-seating function.

The bumper 16 disposed in the receptacle 28 thus, when engaged by the movable arm 12, dissipates the energy of the movable arm 12 in a desirable fashion while re-seating the bumper 16 in the receptacle 28. The configuration of the retention members that are engaged with the bumper 16 facilitates retention of certain portions of bumper 16 while permitting deformation of other, adjacent portions of the bumper 16, with such deformation dissipating the energy of the movable arm 12. The bumper 16 can be retained in the receptacle 28 without requiring the use of an adhesive in contact with the bumper 16, and the bumper 16 can be readily removed and replaced if desired.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising;

a case;

a plurality of retention members disposed on the case;

a resilient bumper engaged by at least a pair of retention members of the plurality of retention members to retain the bumper on the case;

a movable arm disposed on the case, the movable arm being structured to impact the bumper in at least a first predetermined situation to dissipate kinetic energy of the movable arm; and wherein the case has a receptacle formed therein, at least a portion of the bumper being disposed in at least a portion of the receptacle, at least a first retention member of the plurality of retention members being a wall disposed adjacent the receptacle, the bumper having an exterior surface, the exterior surface including a first surface and a second surface that intersect one another at an intersection, the second wall being engageable with the intersection and being oriented oblique to the first surface and the second surface.

2. A circuit breaker comprising:

a case;

a plurality of retention members disposed on the case;

a resilient bumper engaged by at least a pair of retention members of the plurality of retention members to retain the bumper on the case;

a movable arm disposed on the case, the movable arm being structured to impact the bumper in at least a first predetermined situation to dissipate kinetic energy of the movable arm;

wherein at least a portion of the bumper protrudes from the receptacle; and wherein the bumper has an exterior surface, the exterior surface including a first surface and a second surface that intersect one another at a corner, the movable arm being structured to impact the corner of the bumper in the at least a first predetermined situation to provide with the bumper a progressive spring rate, the corner being disposed on the at least a portion of the bumper.

* * * * *